US006925988B2

(12) United States Patent
Potz et al.

(10) Patent No.: US 6,925,988 B2
(45) Date of Patent: Aug. 9, 2005

(54) FUEL-INJECTION SYSTEM FOR INTERNAL COMBUSTION ENGINES

(75) Inventors: Detlev Potz, Stuttgart (DE); Thomas Kuegler, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 88 days.

(21) Appl. No.: 10/169,713

(22) PCT Filed: Nov. 17, 2001

(86) PCT No.: PCT/DE01/04337

§ 371 (c)(1),
(2), (4) Date: Oct. 28, 2002

(87) PCT Pub. No.: WO02/42637

PCT Pub. Date: May 30, 2002

(65) Prior Publication Data

US 2003/0075154 A1 Apr. 24, 2003

(30) Foreign Application Priority Data

Nov. 22, 2000 (DE) ..... 100 58 130

(51) Int. Cl.[7] ..... F02M 37/04
(52) U.S. Cl. ..... 123/447; 123/514
(58) Field of Search ..... 123/446, 299, 123/300, 447, 467, 514, 496

(56) References Cited

U.S. PATENT DOCUMENTS 5,199,402 A 4/1993 Melchior
5,413,076 A * 5/1995 Koenigswieser et al. ... 123/446
5,588,412 A * 12/1996 Nozaki ..... 123/496
6,112,721 A * 9/2000 Kouketsu et al. ..... 123/447
6,378,498 B2 * 4/2002 Kohketsu et al. ..... 123/447
6,457,453 B1 * 10/2002 Tanabe et al. ..... 123/300
6,520,152 B1 * 2/2003 Mahr et al. ..... 123/447

FOREIGN PATENT DOCUMENTS

DE 4115477 * 1/1991 ..... 123/467
EP 0740067 * 10/1996 ..... 123/467

* cited by examiner

*Primary Examiner*—Carl S. Miller
(74) *Attorney, Agent, or Firm*—Ronald E. Greigg

(57) ABSTRACT

A fuel injection system for internal combustion engines, having a high-pressure accumulation chamber, which contains high-pressure fuel, and at least one fuel injection valve, which is connected to the high-pressure accumulation chamber. The fuel injection valve can inject the highly pressurized fuel through injection openings into a combustion chamber of the engine. The fuel injection valve has a control chamber, which is defined by a longitudinally mobile piston and is operationally connected to the fuel injection valve so that the injection cross section of the fuel injection valve is controlled as a function of the hydraulic pressure in the control chamber. A low-pressure accumulation chamber is provided, which can be connected to the control chamber, in which a predetermined fuel pressure is maintained in the low-pressure accumulation chamber that is lower than the pressure in the high-pressure accumulation chamber.

3 Claims, 2 Drawing Sheets

Figure 1:
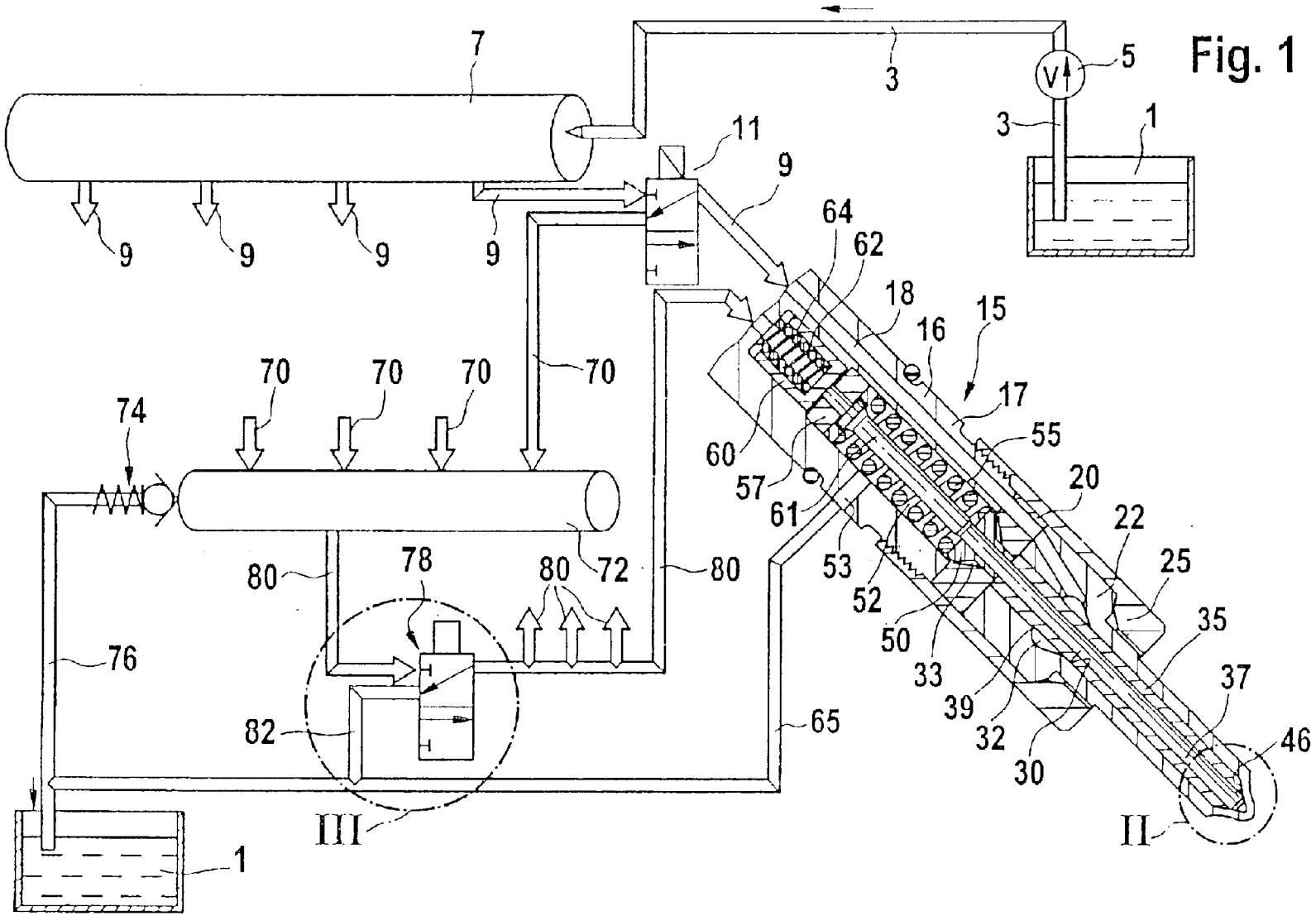

1
5
3
3
7
9
9
9
9
11
15
16
17
18
20
22
25
35
37
46
II
30
32
39
33
50
52
53
55
57
60
61
62
64
65
70
70
70
70
72
74
76
78
80
80
80
82
III
1

FUEL-INJECTION SYSTEM FOR INTERNAL COMBUSTION ENGINES

CROSS-REFERENCE TO RELATED APPLICATIONS

This application is a 35 U.S.C. 371 application of PCT/DE 01/04337, filed on Nov. 17, 2201.

FIELD OF THE INVENTION

The invention is directed to an improved fuel injection system for internal combustion engines.

The known fuel injection system, however, has the disadvantage that only the high pressure that is also used for the injection is available for use as the control pressure. As a result, the control chamber and all of the lines leading to it, as well as the adjusting device, must be correspondingly embodied to be suitable for high pressure. In the injection systems that are common today, which use a high-pressure accumulation chamber, a so-called "common rail", some injection pressures are considerably higher than 100 MPa so that high demands are placed on the mechanics of the adjusting device, the control chamber, and the piston guided therein, which makes these devices complex and correspondingly costly. In addition, pump losses occur during the pressure relief of the control chamber. Moreover, a control valve for the pressure in the control chamber must be provided for each injection valve.

SUMMARY OF THE INVENTION

The fuel injection system according to the invention has the advantage over the prior art that each fuel injection valve of the fuel injection system has a control chamber, which can be connected to a low-pressure accumulation chamber. The control chamber is defined by a piston, which depending on the pressure in the control chamber, controls the injection cross section of the fuel injection valve so that the injection cross section can be controlled via the connection of the low-pressure accumulation chamber to the control chamber by means of a pressure that is lower than the pressure in the high-pressure accumulation chamber.

BACKGROUND OF THE INVENTION

In an advantageous embodiment of the subject of the invention, the low-pressure accumulation chamber is supplied with fuel by means of the fuel pressure in the fuel injection valve. In this case, a high-pressure valve embodied as a 3/2-port directional-control valve is disposed between the high-pressure accumulation chamber that furnishes the fuel with injection pressure, the fuel injection valve, and the low-pressure accumulation chamber. In a first position, the high-pressure valve connects the pressure chamber embodied in the valve body to the low-pressure accumulation chamber while the connection to the high-pressure accumulation chamber is closed off. In a second position of the high-pressure valve, the high-pressure accumulation chamber is connected to the pressure chamber of the fuel injection valve while the connection to the low-pressure accumulation chamber is closed off. During an injection, the full injection pressure of the high-pressure accumulation chamber prevails in the pressure chamber, i.e. the high-pressure valve is disposed in its second position. If the injection is to be terminated, the high-pressure valve switches and the highly pressurized fuel in the pressure chamber is pressure-relieved into the low-pressure accumulation chamber. By means of this, a fuel pressure is built up there, which is kept to a predetermined level by means of a pressure-holding valve. In this way, a predetermined fuel pressure level can be maintained in the low-pressure accumulation chamber without requiring a separate pressure source, for example in the form of an additional fuel pump.

In another advantageous embodiment of the subject of the invention, a control valve can feed the pressure of the low-pressure accumulation chamber into the control chamber or the control chamber can be pressure-relieved into a fuel tank. Because of the relatively low pressure in the low-pressure accumulation chamber, the control valve that controls the control chamber can be embodied as a low-pressure valve, which is much less costly than a control valve for very high fuel pressures. It is also sufficient if all of the lines from the low-pressure accumulation chamber are merely designed to function at this low pressure. In the same way, the control chamber and the piston guided in it can be produced in a correspondingly inexpensive manner.

In another advantageous embodiment of the subject of the invention, a pressure-holding valve is disposed in the leakage fuel line that can connect the low-pressure valve to the control chamber. In this manner, the control chamber is always kept at a certain fuel pressure, but one that is lower than the pressure in the low-pressure accumulation chamber. This residual pressure in the control chamber can function as a so-called oil spring, which continuously exerts a closing force on the corresponding valve needle by means of the hydraulic force on the piston. This permits the elimination of a closing spring, which is normally required to continuously exert a closing force on the valve needle that is connected to the piston.

BREIF DESCRITPION OF THE DRAWINGS

Figure 2:
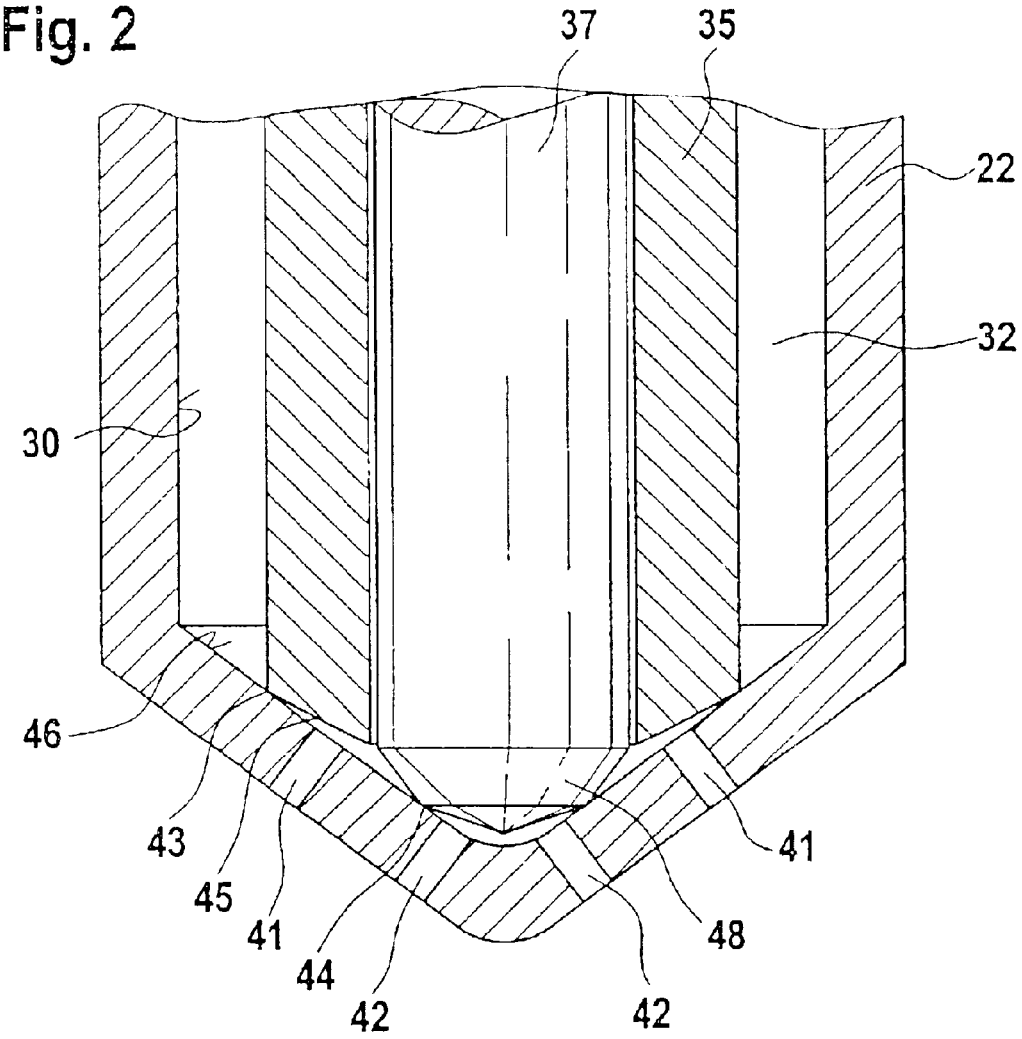
Figure 3:
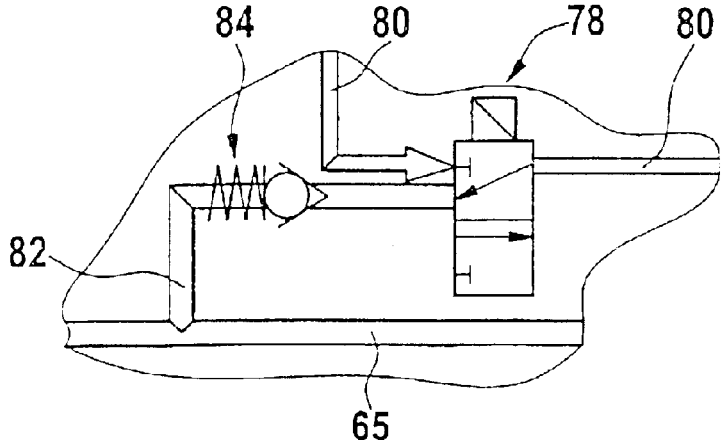

An exemplary embodiment of the fuel injection system according to the invention is described more fully herein below, with reference to the drawings, in which:

FIG. 1 shows a schematic design of a fuel injection system of the invention, together with a longitudinal section through a fuel injection valve, FIG. 2 is an enlarged depiction in the seat region of the fuel injection valve shown in FIG. 1, and FIG. 3 is an enlarged depiction of another exemplary embodiment of the fuel injection system in the vicinity of the low-pressure valve.

DESCRIPTION OF THE PREFERRED EMBODIMENT

FIG. 1 gives a schematic depiction of a fuel injection system for internal combustion engines, in which a fuel injection valve 15 is shown in a longitudinal section and the remaining components of the fuel injection system are schematically depicted. Fuel is supplied from a fuel tank 1 via a fuel line 3 to a high-pressure pump 5, which sends it further via the fuel line 3 to a high-pressure accumulation chamber 7. A control device that is not shown in the drawing assures that a predetermined high fuel pressure level is maintained at all times in the high-pressure accumulation chamber 7. High-pressure lines 9 lead from the high-pressure accumulation chamber 7 and can each be connected to a fuel injection valve 15. Only one of these fuel injection valves 15 is shown in FIG. 1. The high-pressure line 9 is connected to a high-pressure valve 11, which is embodied as a 3/2-port directional-control valve. From the high-pressure valve 11, the high-pressure line 9 continues to the fuel injection valve 15. The fuel injection valve 15 has a housing 16, which is comprised of a valve holding body 17, an intermediary disc 20, and a valve body 22; a retaining nut 25 secures the valve body 22 axially against the valve holding body 17 with the interposition of the intermediary disc 20. The valve body 22 contains a bore 30 in which a valve needle in the form of a hollow needle 35 is guided in a longitudinally mobile fashion. At the combustion chamber end of the bore 30, there is a valve seat 46 in which two rows of injection openings 41, 42 are provided, which are offset from each other in the axial direction. One row of injection openings 41, 42 here is comprised of a number of injection openings, which are preferably distributed uniformly over the circumference of the valve body 22. FIG. 2 shows an enlarged depiction of FIG. 1 in the vicinity of the valve seat 46. The hollow needle 35 is guided in a sealed fashion in a section of the bore 30 remote from the combustion chamber and tapers toward the combustion chamber forming a pressure shoulder 39, which serves as a pressure surface. At the combustion chamber end, the hollow needle 35 transitions into an outer sealing surface 45, which is essentially embodied as conical, so that at the transition from the outer circumference surface of the hollow needle 35 to the sealing surface 45, an outer sealing edge 43 is formed, which rests against the valve seat 46 in the closed position of the hollow needle 35. At the level of the pressure shoulder 39, a radial expansion of the bore 30 in the valve body 22 constitutes a pressure chamber 32, which encompasses the hollow needle 35 and extends to the valve seat 46. By means of a supply conduit 18, which extends in the valve body 22, intermediary disc 20, and valve holding body 17, and by means of the high-pressure line 9, the pressure chamber 32 can be connected to the high-pressure accumulation chamber 7. The first row of injection openings 41 in the valve seat 46 is situated so that the sealing edge 43 of the hollow needle 35 closes the first row of injection openings 41 off from the pressure chamber 32, which means that no fuel is injected when the hollow needle 35 is in contact with the valve seat 46.

At its end oriented away from the combustion chamber, the hollow needle 35 rests against a spring plate 50, which is disposed in a central opening 33 embodied in the intermediary disc 20. At the transition of the valve body 22 into the intermediary disc 20, the central opening 33 here has a smaller diameter than the bore 30 so that a stop shoulder is formed on the intermediary disc 20, which functions as a stroke limiting stop for the hollow needle 35 during its opening stroke motion. The spring plate 33 protrudes into a spring chamber 52 embodied in the valve holding body 17, which contains a closing spring 55 under a compressive initial stress. In this case, the closing spring 55 rests against a support ring 57 at its end oriented away from the combustion chamber and rests against the spring plate 50 at its end oriented toward the combustion chamber so that the initial stress of the closing spring 55 exerts a closing force on the hollow needle 35 in the direction of the valve seat 46. The spring chamber 52 has a leakage fuel connection 53 to which a leakage fuel line 65 is connected so that the spring chamber 52 continually communicates with the fuel tank 1 and is therefore not pressurized.

A valve needle in the form of an internal needle 37 is guided in a longitudinally mobile fashion inside the hollow needle 35 and at its end oriented toward the combustion chamber, has a conical pressure surface 48, which is bounded by a sealing edge 44. In the closed position of the internal needle 37, the sealing edge 44 rests against the valve seat 46 and thus closes the second row of injection openings 42 off from the pressure chamber 32. At its end oriented away from the combustion chamber, the internal needle 37 transitions into a piston rod 61, which protrudes through the spring plate 50 and the spring chamber 52 into a control chamber 62, which is embodied in the valve holding body 17 at its end further away from the combustion chamber than the spring chamber 52. The control chamber 62 contains a movable piston 60, which is guided in a sealed fashion in the control chamber 62 and is bowl-shaped. The piston 60 is connected to the piston rod 61 so that it moves in the longitudinal direction synchronously with the internal needle 37. The control chamber 62 contains a closing spring 64, which has a compressive initial stress and acts on the internal needle 37 in the closing direction in addition to the hydraulic force that is exerted by the pressure prevailing in the control chamber 62.

In addition, the fuel injection system has a low-pressure accumulation chamber 72 in which a predetermined fuel pressure level is maintained, which is significantly lower than the fuel pressure level of the high-pressure accumulation chamber 7. For example, a pressure prevails in the low-pressure accumulation chamber 72 that is at most approximately one fifth of the pressure in the high-pressure accumulation chamber 7, which can be more than 100 MPa. A diversion line 70 leads from each high-pressure valve 11 to the low-pressure accumulation chamber 72 so that the high-pressure line 9 from the high-pressure accumulation chamber 7, the high-pressure line 9 to the fuel injection valve 15, and the diversion line 70 are either connected to each other or closed off from each other by the 3/2-port directional-control valve function of the high-pressure valve 11. The high-pressure valve 11 can be switched into two switching positions. In the first position, which is shown in FIG. 1, the high-pressure valve 11 connects the high-pressure line 9 coming from the pressure chamber 32 of the fuel injection valve 15 to the diversion line 70, while the connection to the high-pressure accumulation chamber 7 is closed off. In the second position of the high-pressure valve 11, the high-pressure accumulation chamber 7 is connected via the high-pressure line 9 to the pressure chamber 32 of the fuel injection valve 15, while the diversion line 70 is closed off. The first position of the high-pressure valve 11 corresponds to the position in which no fuel is to be injected into the combustion chamber of the internal combustion engine, whereas the second position is selected during the injection of fuel.

The low-pressure accumulation chamber 72 is connected via a leakage fuel line 76 to the fuel tank 1; a pressure-holding valve 74 is disposed in the leakage fuel line 76 so that a predetermined fuel pressure level is maintained at all times in the low-pressure accumulation chamber 72. A control line 80 leads from the low-pressure accumulation chamber 72 to a low-pressure valve 78, which is embodied as a 3/2-port directional-control valve. Downstream of the low-pressure valve 78, the control line 80 splits in accordance with the number of fuel injection valves and feeds into the control chamber 62 of each respective fuel injection valve 15. A leakage fuel line 82 connected to the fuel tank 1 also leads to the low-pressure valve 78. In the first position of the low-pressure valve 78, which is shown in FIG. 1, the control line 80 coming from the control chamber 62 is connected to the leakage fuel line 82 while the control line 80 coming from the low-pressure accumulation chamber 72 is closed. As a result, the control chamber 62 is connected to the fuel tank 1 and is therefore switched into an unpressurized state. In the second position of a low-pressure valve 78, the low-pressure accumulation chamber 72 is connected to the control chamber 62 via the control line 80 while the leakage fuel line 82 is closed. As a result, the fuel pressure on the low-pressure accumulation chamber 72 prevails in the control chamber 62. In the fuel injection system according to the invention, a high-pressure valve 11 must be provided for each fuel injection valve 15, but only one low-pressure valve 78 is required for the entire fuel injection system.

The fuel injection system functions as follows: when the internal combustion engine is operated under partial load, only a relatively small amount of fuel is injected into the combustion chamber of the engine. At the given injection pressure, therefore, only a part of the entire injection cross section should be opened. To this end, the low-pressure valve 78 is switched into the second position so that the low-pressure accumulation chamber 72 is connected to the control chamber 62 of each of the fuel injection valves 15 so that a hydraulic force on the piston 60 is exerted and the piston rod 61 and thereby the internal needle 37 are pressed into the closed position. At the onset of injection, the high-pressure valve 11 is switched into the second position so that the high-pressure accumulation chamber 7 is connected to the pressure chamber 32 via the high-pressure line 9 and the supply conduit 18. As a result, highly pressurized fuel flows into the pressure chamber 32 and exerts a hydraulic force on the pressure shoulder 39 of the hollow needle 35. As soon as this hydraulic force on the pressure shoulder 39 exceeds the force of the closing spring 55, the hollow needle 35 moves away from the valve seat 46 and lifts its sealing edge 43 up from the valve seat 46. As a result, the pressure chamber 32 is connected to the first row of injection openings 41 and fuel is injected through them into the combustion chamber of the engine. Since at this point, the fuel pressure is also exerted on the pressure surface 48, a hydraulic force is also exerted on the internal needle 37 in the opening direction. However, the fuel pressure in the control chamber 62 compensates for this hydraulic force so that the internal needle 37 remains in the closed position. If the injection is to be terminated, the high-pressure valve 11 is switched back into the first position so that the connection to the high-pressure accumulation chamber 7 is closed. The pressure chamber 32 is now connected via the supply conduit 18 and the high-pressure line 9 to the diversion line 70 and therefore to the low-pressure accumulation chamber 72. The residual pressure in the pressure chamber 32 is now pressure-relieved into the low-pressure accumulation chamber 72 so that a diversion flow into the low-pressure chamber 72 is produced, which increases the fuel pressure therein. As soon as the fuel pressure in the low-pressure accumulation chamber 72 exceeds a predetermined level, the pressure-holding valve 74 opens and fuel flows out of the low-pressure accumulation chamber 72 back into the fuel tank 1. Because of the currently falling pressure in the pressure chamber 32, the hydraulic force on the pressure shoulder 39 also decreases and, due to the force of the closing spring 55, the hollow needle 35 is pressed back into the closed position and the injection openings 41 are closed once more. The leakage fuel flows, which are caused by the high-pressure difference between the pressure chamber 32 and the spring chamber 52 and which flow toward the spring chamber 52, are carried away by the leakage fuel line 65 so that the fuel pressure level of the fuel tank 1 is maintained in the spring chamber 52. If the internal combustion engine is to be operated at full load, then both rows of injection openings 41, 42 are opened. To this end, the low-pressure valve 78 is switched into the first position so that the control chamber 62 is now pressure-relieved via the control line 80 and the leakage fuel line 82. The first part of the injection occurs as described above in connection with the partial load operation but now, after the hollow needle 35 is moved into the open position, the exertion of pressure on the pressure surface 48 also moves the internal needle 37 into the open position so that the second row of injection openings 42 is also unblocked and fuel from the pressure chamber 32 is injected through the entire injection cross section. In this operational mode, only the force of the closing spring 64 is exerted on the internal needle 37 so that the hydraulic pressure on the pressure surface 48 is now sufficient to produce an opening stroke motion. The end of the injection takes place as described above through the switching of the high-pressure valve 11.

FIG. 3 shows another exemplary embodiment of the fuel injection system; in this instance, only a detail in the vicinity of the low-pressure valve 78 is depicted. The low-pressure valve 78 in this exemplary embodiment functions the same way as in the exemplary embodiment shown in FIG. 1, but in this instance, a pressure-holding valve 84 is disposed in the leakage fuel line 82. In the first position of the low-pressure valve 78, which is shown in FIG. 3, the control chamber 62 is not completely pressure-relieved, but instead, a residual pressure remains, which is determined by the pressure-holding valve 84. Through a suitable design, this hydraulic residual pressure can exert a force on the piston 60, which corresponds to the force of the closing spring 64 so that the closing spring 64 can be eliminated. Therefore a so-called oil spring is used in lieu of the closing spring 64.

The low-pressure accumulation chamber 72 is supplied with fuel at a sufficient pressure exclusively by means of the diversion flow from the fuel injection valves 15. An additional fuel pressure source, for example in the form of an additional fuel pump, can therefore be eliminated. Since all of the fuel injection valves 15 of the internal combustion engine are connected to the low-pressure accumulation chamber 72, the operational mode, i.e. partial load operation or full load operation, can be set synchronously for all of the fuel injection valves 15 through a corresponding switching of the low-pressure valve 78.

The foregoing relates to preferred exemplary embodiments of the invention, it being understood that other variants and embodiments thereof are possible within the spirit and scope of the invention, the latter being defined by the appended claims.

What is claimed is:

1. A fuel injection system for internal combustion engines, comprising a high-pressure accumulation chamber (7), which contains highly pressurized fuel, at least one fuel injection valve (15), which is connected to the high-pressure accumulation chamber (7) and which can inject the highly pressurized fuel through injection openings (41, 42), which constitute an injection cross section, into a combustion chamber of the engine, a control chamber (62), which is defined by a longitudinally mobile piston (60) and is operationally connected to the fuel injection valve (15) so that the injection cross section of the fuel injection valve (15) is controlled as a function of the hydraulic pressure in the control chamber (62), and a low-pressure accumulation chamber (72) which can be connected to the control chamber (62), in which a predetermined fuel pressure is maintained in the low-pressure accumulation chamber (72) that is lower than the pressure in the high-pressure accumulation chamber (7), wherein in order to control the injection openings (41; 42), at least one valve needle (35; 37) is disposed so that it can move longitudinally in a bore (30) of the fuel injection valve (15), counter to a closing force, each at least one valve needle having a pressure surface (39; 48), which is disposed in a pressure chamber (32) that can be connected to the high-pressure accumulation chamber (7) so that the pressure in the pressure chamber (32) can move the valve needle (35; 37) longitudinally, counter to the closing force, in which the valve needle (35; 37) is connected to the piston (60), and wherein the high-pressure accumulation chamber (7), the low-pressure accumulation chamber (72), and the pressure chamber (32) are connected to a high-pressure valve (11) so that in a first position of the high-pressure valve (11), the high-pressure accumulation chamber (7) is connected to the pressure chamber (32) while the connection to the low-pressure accumulation chamber (72) is closed off, and in a second position of the high-pressure valve (11), the low-pressure accumulation chamber (72) is connected to the pressure chamber (32), while the connection to the high-pressure accumulation chamber (7) is closed off.

2. A fuel injection system for internal combustion engines, comprising a high-pressure accumulation chamber (7), which contains highly pressurized fuel, at least one fuel injection valve (15), which is connected to the high-pressure accumulation chamber (7) and which can inject the highly pressurized fuel through injection openings (41, 42), which constitute an injection cross section, into a combustion chamber of the engine, a control chamber (62), which is defined by a longitudinally mobile piston (60) and is operationally connected to the fuel injection valve (15) so that the injection cross section of the fuel injection valve (15) is controlled as a function of the hydraulic pressure in the control chamber (62), and a low-pressure accumulation chamber (72) which can be connected to the control chamber (62), in which a predetermined fuel pressure is maintained in the low-pressure accumulation chamber (72) that is lower than the pressure in the high-pressure accumulation chamber (7), wherein the low-pressure accumulation chamber (72), an unpressurized fuel tank (1), and the control chamber (62) are connected by means of a low-pressure valve (78) whereby in a first position of the low-pressure valve (78), the fuel tank (1) is connected to the control chamber (62) while the connection to the low-pressure accumulation chamber (72) is closed off, and in a second position of the low-pressure valve (78), the low-pressure accumulation chamber (72) is connected to the control chamber (62) while the connection to the fuel tank (1) is closed off.

3. The fuel injection system according to claim 2 wherein the fuel tank (1) is connected to the low-pressure valve (78) via a leakage fuel line (82) and a pressure-holding valve (84) is disposed in the leakage fuel line (82) so that in the first position of the low-pressure valve (78), the fuel pressure in the control chamber (62) does not exceed a predetermined pressure.

* * * * *